United States Patent [19]

Despault et al.

[11] Patent Number: 4,741,480

[45] Date of Patent: May 3, 1988

[54] ELECTRICAL CONNECTORS

[75] Inventors: Paul R. Despault, Kirkland; Roger Paradis, Boucherville; George Debortoli, Ottawa, all of Canada

[73] Assignee: Northern Telecom Limited, Montreal, Canada

[21] Appl. No.: 68,303

[22] Filed: Jul. 1, 1987

[51] Int. Cl.[4] ..... H01R 4/24

[52] U.S. Cl. ..... 439/412

[58] Field of Search ..... 439/391, 392, 395–400, 439/411, 412, 417, 418, 431

[56] References Cited

U.S. PATENT DOCUMENTS

| | | | |
|---|---|---|---|
| 2,235,231 | 3/1941 | Mattis | 439/412 |
| 2,930,021 | 3/1960 | Hasselhorn et al. | 439/413 |
| 4,423,918 | 1/1984 | Fibreis et al. | 439/412 |

*Primary Examiner*—Joseph H. McGlynn
*Attorney, Agent, or Firm*—R. J. Austin

[57] ABSTRACT

Electrical connector with an insulation displacement member within an insulating body and a closure member for covering an insulation displacement terminal of the insulation displacement member. Two passages are provided into the closure member, one for guiding large diameter insulated wires to the position of the insulation displacement terminal and a second for smaller diameter wires. The second passage extends at an angle to the first passage and opens into the first passage close to the terminal position to produce a bend in the smaller diameter wire adjacent to the terminal position whereby the smaller diameter wire is stiffened at the terminal position.

7 Claims, 2 Drawing Sheets

ELECTRICAL CONNECTORS

ELECTRICAL CONNECTORS

This invention relates to electrical connectors.

Many designs of electrical connectors are known. In some electrical connectors, insulation displacement terminals are used. Such terminals comprise opposed electrically conductive surfaces for electrical engagement with a conductor wire. These electrically conductive surfaces are spaced apart to provide a gap to accommodate the wire and this gap has an entry for lateral movement of the wire between the surfaces. At the entry to the gap, commonly the surfaces diverge to form guide surfaces for guiding insulated conductor wire towards the gap. At the position at the entry to the gap the guide surfaces and the electrically conductive surfaces form a junction which provides a cutting edge and this cutting edge removes the insulation from around the wire as the wire is moved into the gap to enable the electrically conductive surfaces to electrically engage the wire.

Electrical connectors having insulation displacement terminals are normally used to accommodate conductor wire within a narrow range of diameters. In some connectors, the wire is located approximately in its required position and the terminal is moved against the wire to make the connection. The guide surfaces will automatically guide the conductor wire into the gap of the insulation displacement terminal. In cases where insulated wire of smaller diameter than the predetermined range of diameters for connection to a terminal has been fed into the connector, then this smaller diameter has resulted in an increased tendency for lateral movement of the wire within the connector body and thus misalignment with the insulation displacement terminal. Misalignment and wire flexibility result in lack of electrical connection with the terminal. Thus, as the insulation displacement terminal is moved across the wire at a wire terminal position, it has been known for smaller diameter wire to be deflected sideways by the terminal and away from the gap. As a result, the smaller diameter wire, still bearing its insulation, may become jammed between surfaces of the insulation displacement terminal and of the body of the connector.

The only known way of overcoming this problem, if an electrical connector is to be used successfully for a wider range of conductor wire diameters, is to provide more than one terminal and more than one guide passage. However, this arrangement means duplication of insulation displacement terminals which increases the cost of connectors and also complicates their design.

The present invention seeks to provide an electrical connector which avoids the duplication of insulation displacement terminals while allowing for the use of the connector with a wider range of outside diameters of insulated conductor wires.

Accordingly, the invention provides an electrical connector having an insulating body, a closure, and an insulation displacement contact member carried within the insulating body, the contact member formed at one end with an insulation displacement terminal projecting from the insulating body, the closure member and the body being relatively movable to cause the closure member to cover the insulation displacement terminal, the closure member having a first passage for guidance of an insulated conductor wire within a certain range of outside diameters into and beyond a wire terminal position within the closure member, the closure member also formed with: entry and exit passages for the insulation displacement terminal, the entry and exit passages aligned across the first passage, and a second passage for guidance of an insulated conductor wire within another and smaller range of outside diameters, the second passage being of smaller cross-sectional area than the first passage, extending at an angle to the first passage towards the wire terminal position and having an opening into the first passage to direct the smaller diameter wire across the exit passage and through the terminal position, said opening of the second passage being sufficiently close to the terminal position to produce a bend in the smaller diameter wire adjacent the terminal position so as to stiffen the wire in the terminal position.

As can be seen from the connector according to the invention, a smaller diameter wire located through the second passage is prevented from having substantial lateral movement as it crosses the terminal position thereby holding it in position to enable the insulation displacement terminal to become electrically connected to it. In addition to this, the second passage in lying at an angle to the first passage and opening close to the terminal position causes the smaller diameter wire to bend as it extends from the second into the first passage. Formation of bend in the smaller diameter wire increases its stiffness in the terminal position so as to increase its resistance to flexure to one side as the insulation displacement terminal moves into its operative position.

One embodiment of the invention will now be described, by way of example, with reference to the accompanying drawings, in which.

Figure 1:
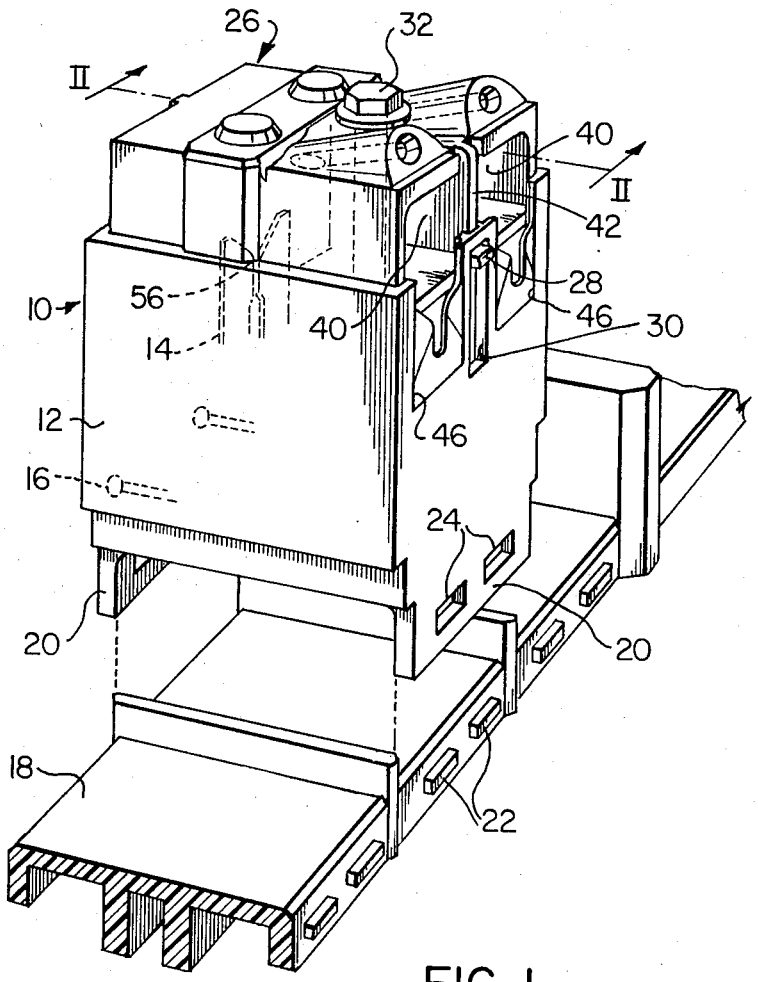
FIG. 1 is an isometric view of a connector according to the embodiment showing it in a position exploded from a rigid mount.

As shown by FIG. 1, an electrical connector 10 has a plastic block housing 12 for accommodating two contact members 14 (one shown in FIG. 1), each having an insulation displacement terminal at each end for electrically connecting the conductors of a main cable (not shown) to a service cable such as a drop wire. The method of connection of the contact members 14 to the conductors of the main cable need not be described in this embodiment and it has no bearing on the invention. However, the conductors of the main cable may be connected to the contact members in the manner described in British Patent Application No. 8606039, U.K. Publication No. 2173650A, published Oct. 15, 1986. The conductors of the main cable are inserted through holes 16 towards the bottom of the housing 12 for connection to the contact members 14. The connector 10 is made for assembly upon a rigid mounting 18 in line with other similar connectors. For each connector 10, the housing has two downward extensions 20 so that the housing may straddle across the mounting 18 and receive locking projections 22 of the mounting within holes 24 formed at the lower ends of the housing.

Figure 5:
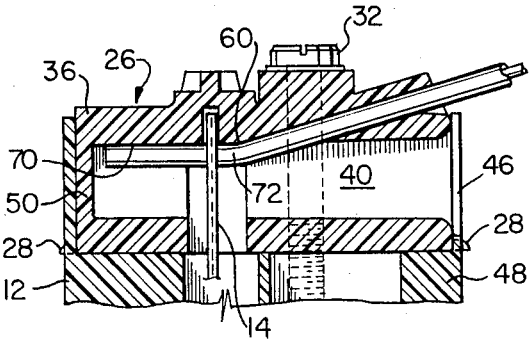
FIG. 5 is a view similar to FIG. 3 showing the electrical connection of the wire to the insulation displacement terminal.

The two contact members 14 are formed from planar conductive metal and lie substantially in the same plane side-by-side within the housing 12. A closure member 26 surmounts the housing 12 and is movable between a retracted position (FIG. 1) and a fully retained or closed position (FIG. 5). The closure member is slidable within walls of the housing and has two retaining projections 28, one at each side, and these retaining projections are received within vertical guide slots 30 in opposing walls of the housing 12. A screw 32 is held rotatably captive by the closure member 26 and the lower end of this screw is received in a screw threaded hole in the housing 12 to control the movement of the closure member between the retracted and fully retained positions. The arrangement of the closure member together with the action of the screw are described fully in the aforementioned U.K. Publication No. 2173650A.

With the closure member in its retracted position shown in FIG. 1, the two contact members 14 are disposed directly beneath two insulation displacement terminal positions provided within the closure member 26. As shown in detail in FIG. 2, the closure member 26 comprises a body 34 formed from rigid molded insulating plastics material. The body has an upper wall 36 and a lower wall 38 which between them define two horizontal passages 40 for acceptance of insulated conductor wires having diameters lying between a certain range. The two passages 40 are separated by a vertical wall 42 (FIG. 1) extending between the upper and lower walls. The two passages 40 have entrances 44 which with the closure member 26 in its fully retained and lower position lie in alignment with downwardly extending recesses 46 formed in one of the walls 48 of the housing 12. This is to enable insulated conductor wires to pass through the slots 46 and into the passages 40. As can be seen from FIG. 2, each passage 40 extends across a wire terminal position indicated generally at 48 and also beyond that position to enable conductor wire to pass along the passage 40 and into and beyond the wire terminal position. An end wall 50 extending between upper and lower walls 36 and 38 forms a blind end for each passage 40.

In respect of each passage 40, the body 34 is also formed with an entry passage 52 and an exit passage 54 for movement of the insulation displacement terminal 56 (see FIG. 1) of a respective contact member 14 as the closure member 26 moves downwardly into its fully retained position. The entry and exit passages and the wire terminal position 48 for each passage 40 are aligned across the respective passage 40.

The body of the closure member is also formed with a second passage 58 for insertion of another insulated conductor wire lying within a smaller diameter range than the wires to be accommodated along the passage 40. Each passage 58, as seen clearly in FIG. 2, extends into the body 34 from a position above the inlet 44 to the respective passage 40, is inclined downwardly towards the terminal position 48 and merges with the passage 40 at a position slightly before the terminal position 48. The passage 58 may lie at any desired angle to achieve the required results which are to be discussed. Preferably, that angle should lie between 10° and 20° to the horizontal, but in this embodiment the angle of the passage 58 is approximately 16° to the axis of passage 40.

Figure 2:
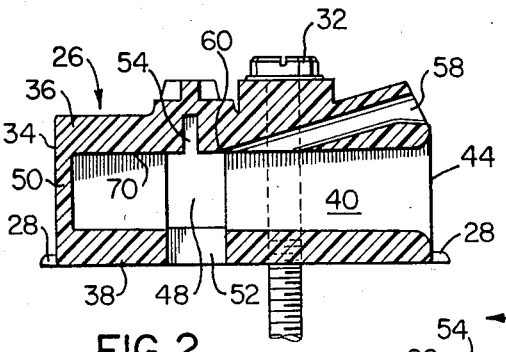
FIG. 2 is a cross-sectional view through a closure member forming a top of the connector in FIG. 1 and taken along line II—II in FIG. 1 to a larger scale.

As can be seen from the vertical section in FIG. 2, the passage 58 is in planar alignment with the passage 40 so as to direct a small diameter wire across the passage 40 and through the terminal position. The opening of the second passage 58 into the passage 40 has an edge a part 60 of which lying closest to the exit aperture is between 0.040 and 0.060 cm from the exit aperture 54. In the embodiment this distance is actually 0.05 cm. At this part 60 of the edge of the opening, the wall of the passage 58 forms an abrupt junction with the wall of the passage 40 as shown by FIG. 2.

Figure 3:
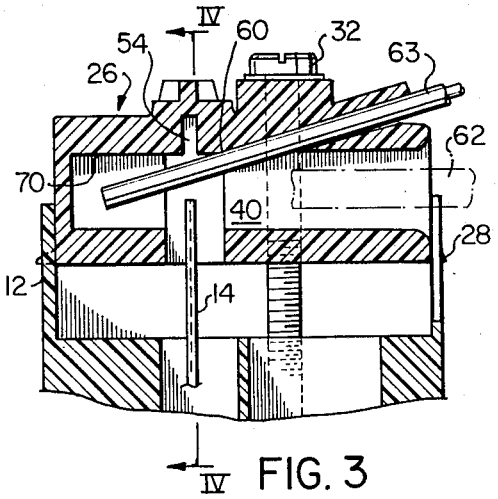
FIG. 3 is a view similar to FIG. 2 and showing the upper part of the connector which includes the closure member together with a wire in position preparatory to making an electrical connection with an insulation displacement terminal.
Figure 4:
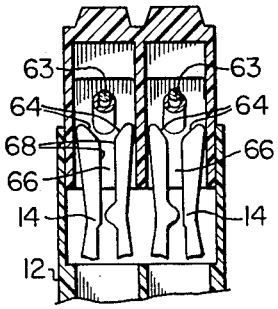
FIG. 4 is a cross-sectional view through the connector taken along line IV—IV in FIG. 3.

In use of the connector 10, and with the connector mounted upon the mounting 18, the conductors of the main cable are connected through the apertures 16 to the lower end of the contact member 14. This is discussed fully in aforementioned U.K. Publication No. 2173650A. With the closure member in its upper or retracted position shown in FIGS. 1 and 3, the closure member may be used to insert a large diameter insulated wire along passage 40 through the wire terminal position or for the insertion of a smaller diameter wire along the passage 58 and through the terminal position. In the one alternative arrangement, a wire 62 of large diameter is shown extending into passage 40 in FIG. 3 in chain dotted outline. However, as the inventive concept is involved with the passage 58 then, in the use of the embodiment, a smaller diameter wire 63 is shown in full outline extending through the passage 58 and across the wire terminal position for connection to the insulation displacement terminal 56 of the respective contact member 14. With the wire 63 extending into the position shown, it will be appreciated that substantial support is provided for the insulated conductor along the whole of its length in the passage 58 so as to rigidify that part of the conductor wire. As the closure member is moved downwardly into its fully retained position shown by FIG. 5, the terminals 56 of the contact member 14 are caused to enter the entry passages 52 and proceed across the wire terminal positions 48 before passing into the exit passages 54. As each terminal 56 moves across the passage 40, the narrow passage 58 holds the associated wire 63 substantially centrally with regard to the passage 40 as the wire extends across the wire terminal position 48. This is shown by the section of FIG. 4. As the terminal 56 proceeds to move across the passage 40, one or other of its inclined guide surfaces 64 engage with the small diameter wire which is approximately aligned with a gap 66 existing between opposed electrically conductive surfaces 68 of the terminal. The short distance between the opening to the passage 58 and the terminal position 48 allow for negligible sideways movement of the insulated wire. Further movement of the terminal 56 across passage 40 raises the end of conductor wire 62 within the passage 40 until the wire engages the upper surface 70 of the passage 40. At this stage the insulated conductor wire is engaged substantially along the whole of the length of the part of the wire contained within the closure member. This engagement serves to add stiffness and control to the wire centrally within the passage 40. This stiffness is increased by the closeness of the bend 72 of the wire at position 60 to the exit aperture 54. Thus as the terminal 56 proceeds to move into the exit passage 54, the stiffness of the wire is increased substantially beyond its normal unrestrained stiffness. In addition, the width of exit passage 54 is minimized to allow for comfortable movement of terminal 56 without possibility of squashing the wire between passage and terminal. In this embodiment, the terminal 56 is 16 mil thick and the passage 54 is 35 mil wide.

It has been found that with this closure member, the stiffness of small diameter wires has been increased sufficiently to cause them to resist movement of the insulation displacement terminals. As a result, each terminal has been effective in guiding the wire towards the gap 66 and in severing the insulation from around the conductor to force the conductor along the gap 66 to provide an electrical connection with the terminal as the terminal moves into its final position in the closure member. Thus, in use of the connector as described in the embodiment and according to the invention, any possibility of small conductor wires being deflected from their required positions during formation of an electrical connection is minimized.

What is claimed is:

1. An electrical connector having an insulation body, a closure member and an insulation displacement contact member carried within the insulating body, the contact member formed at one end with an insulation displacement terminal projecting from the insulating body, the closure member and the body being relatively movable to cause the closure member to cover the insulation displacement terminal, the closure member having a first passage for guidance of an insulated conductor wire within a certain range of outside diameters into and beyond a wire terminal position within the closure member, the closure member also formed with:

(a) entry and exit passages for the insulation displacement terminal, the entry and exit passages aligned across the first passage; and (b) a second passage for guidance of an insulated wire within another and smaller range of outside diameters, the second passage being of smaller cross-sectional area than the first passage, extending at an angle to the first passage towards the wire terminal position and having an opening into the first passage to direct the smaller diameter wire across the exit passage and through the terminal position, said opening of the second passage being sufficiently close to the terminal position to produce a bend in the smaller diameter wire adjacent to the terminal position so as to stiffen the wire in the terminal position.

2. A connector according to claim 1 wherein the angle of the first passage to the second passage is between 10° and 20°.

3. A connector according to claim 2 wherein the second passage has a diameter between 0.05 and 0.065 cm and the opening has an edge a part of which lying closest to the exit aperture is between 0.04 and 0.06 cm from the exit aperture.

4. A connector according to claim 3 wherein at said closest part of the opening to the exit aperture, the second passage has a wall forming an abrupt junction with the wall of the first passage.

5. A connector according to claim 2 wherein said angle is approximately 16°.

6. A connector according to claim 3 wherein said angle is approximately 16°.

7. A connector according to claim 4 wherein said angle is approximately 16°.

* * * * *